US011091974B2

(12) United States Patent
Corso et al.

(10) Patent No.: US 11,091,974 B2
(45) Date of Patent: Aug. 17, 2021

(54) ADJUSTABLE INNER RISER MANDREL HANGER ASSEMBLY

(71) Applicant: Chevron U.S.A. Inc., San Ramon, CA (US)

(72) Inventors: Vicki Deck Corso, Richmond, TX (US); John Lloyd Busby, Spring, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/683,363

(22) Filed: Nov. 14, 2019

(65) Prior Publication Data

US 2021/0148182 A1 May 20, 2021

(51) Int. Cl.
*E21B 33/04* (2006.01)
*E21B 33/038* (2006.01)

(52) U.S. Cl.
CPC ..... *E21B 33/0422* (2013.01); *E21B 33/038* (2013.01)

(58) Field of Classification Search
CPC ..... E21B 33/04; E21B 33/03; E21B 33/038
See application file for complete search history.

(56) References Cited

U.S. PATENT DOCUMENTS 3,561,527 A * 2/1971 Nelson ..... E21B 33/043 285/123.2
4,736,799 A * 4/1988 Ahistone ..... E21B 33/047 166/182
5,878,816 A * 3/1999 Lalor ..... E21B 33/04 166/268
6,394,186 B1 * 5/2002 Whitelaw ..... E21B 12/04 166/349
8,261,837 B2 9/2012 Leonard et al.
9,347,280 B2 5/2016 Vanderford et al.

* cited by examiner

*Primary Examiner* — James G Sayre
(74) *Attorney, Agent, or Firm* — King & Spalding LLP

(57) ABSTRACT

The present disclosure provides adjustable mandrel hanger assemblies and methods of their use. The adjustable mandrel hanger assembly includes an upper wellhead component, a lower wellhead component comprising a load shoulder, a mandrel hanger with a protrusion disposed on an exterior of the mandrel hanger, a seal assembly, and a height adjustment ring, wherein the height adjustment ring fits securely around a protrusion of the mandrel hanger and wherein a largest exterior diameter of the height adjustment ring is greater than an interior diameter of the load shoulder.

20 Claims, 9 Drawing Sheets

ADJUSTABLE INNER RISER MANDREL HANGER ASSEMBLY

TECHNICAL FIELD

The present application relates to a height adjustable mandrel hanger assembly. The mandrel hanger includes adjustment rings that, when attached to a mandrel hanger, adjust the height of the mandrel hanger with respect to a load shoulder, thereby increasing tension in a pipe string.

BACKGROUND

On an off-shore rig used for producing hydrocarbons, the inner riser of a dry tree riser system extends from the subsea wellhead assembly to the surface wellhead assembly on a platform. The lower end of the inner riser is attached to the subsea wellhead using an internal tieback connector and the upper end is attached to a surface hanger mandrel. The riser string must be placed into tension or buckling and fatigue failure in the riser can occur due to the movement of the facility in the environment (current, waves, etc.). The tension is applied at the surface via a mandrel hanger system, through the surface wellhead assembly and tension joint, and then supported by the tensioner on the platform. Currently, mandrel hangers comprise grooves or threads onto which a hanger is attached. After landing and tensioning a pipe string the excess upper portion of the mandrel hanger is cut off to allow the installation of the surface wellhead tubing spool or Christmas tree. After being cut off, the mandrel hanger is machined in order to provide a proper primary barrier seal and secondary seal surface as well as providing entry to properly install seals.

A conventional installation procedure comprises running a riser hanger mandrel as the last joint of a riser string. After the internal tieback is set and lockdown is verified, an overpull on the internal riser is performed to the project's specified requirements. The inner riser is then tested. After testing, the riser is pulled to the desired tension. Once the desired tension is reached, a first mark is placed on the hanger mandrel thread even with the top of the casing head. The operator continues to apply tension to allow a given measurement to be marked on the hanger mandrel thread below the first marked measurement and a hanger support load ring is installed at some distance below the first mark. The hanger support load ring is lowered into the casing and landed out. A chip pan device is installed between the casing head and casing hanger mandrel and a trap is installed around the casing head to prevent any metal shavings from entering the hole. The mandrel hanger is then cut above the top of the casing head. The mandrel hanger is machined to remove thread and grooves on the mandrel hanger for proper sealing and a bevel is created to allow for installation of the tubing head assembly. The seal is installed and tested, followed by installation of a tubing head assembly. The cutting and machining processes take an average of 6 hours.

The foregoing summary of a conventional installation procedure can present challenges and shortcomings. Accordingly, an improved installation procedure would be desirable.

SUMMARY

In general, in one aspect, the disclosure relates to an adjustable mandrel hanger assembly comprising: an upper wellhead component; a lower wellhead component comprising a load shoulder; a mandrel hanger sized such that it can slide into the upper and lower wellhead components, wherein the mandrel hanger comprises a protrusion disposed on an exterior of the mandrel hanger; a seal assembly sized such that it can seal the annulus between the mandrel hanger and the lower wellhead component; and a height adjustment ring, wherein the height adjustment ring fits around the mandrel hanger contacting at least a portion of the protrusion and wherein a largest exterior diameter of the height adjustment ring is greater than an interior diameter of the load shoulder. In some embodiments, the assembly further comprises a plurality of bit guides, wherein each bit guide of the plurality of bit guides is a different height. In embodiments, a largest exterior diameter of the protrusion is less than the interior diameter of the load shoulder, in others, a largest exterior diameter of the protrusion is greater than the interior diameter of the load shoulder. In some embodiments, an interior of the height adjustment ring is contoured to fit around at least the portion of the protrusion. The height adjustment ring, the exterior of the mandrel hanger, and an interior of the load shoulder can be threadless and grooveless. In further embodiments, the assembly further comprises a second height adjustment ring having a second height that is different from a height of the height adjustment ring. The height adjustment ring and the second height adjustment ring can be configured to stack against each other, creating a larger height. In specific embodiments, the height adjustment ring comprises two half circular sections that can be secured to each other to form the height adjustment ring. The upper wellhead component can be a spool, a wellhead, a tree body component, a casing header, or a casing spool, tubing head, tubing spool, or crossover spool, or multi-stage cross-over spool. The lower wellhead component can be a spool, a wellhead, a tree body component, a casing header, or a casing spool, tubing head, tubing spool, or crossover spool, or multi-stage cross-over spool.

Another general embodiment of the disclosure is a method of adjusting the tension in a mandrel hanger assembly comprising: attaching one end of a mandrel hanger to a pipe string, the mandrel hanger comprising a protrusion disposed on an exterior of the mandrel hanger; attaching an opposite end of the mandrel hanger to a running tool; raising the mandrel hanger to create tension in the pipe string; installing an adjustment ring on the mandrel hanger, wherein the adjustment ring contacts at least a portion of the protrusion; lowering the mandrel hanger and landing the mandrel hanger on a load shoulder of a lower wellhead component; detaching the mandrel hanger from the running tool; installing a seal in an annulus between the mandrel hanger and the lower wellhead component; and attaching an upper wellhead component to the lower wellhead component. In some embodiments, a second adjustment ring is stacked on the adjustment ring. In embodiments, a largest exterior diameter of the protrusion is less than an interior diameter of the load shoulder and in other embodiments a largest exterior diameter of the adjustment ring is greater than the interior diameter of the load shoulder. In some embodiments, an interior of the adjustment ring is contoured to fit around at least a portion of the protrusion. In embodiments, the adjustment ring and the second adjustment ring comprise different interior contours. The pipe string can be a riser, an inner riser, a liner, a production string, a tieback string, or a casing. The upper wellhead component can be a spool, a wellhead, a tree body component, a casing header, or a casing spool, tubing head, tubing spool, or crossover spool, or multi-stage cross-over spool. The lower wellhead component can be a spool, a wellhead, a tree body component, a casing header, or a casing spool, tubing head, tubing spool, or crossover spool, or multi-stage cross-over spool. Some embodiments additionally comprise installing a bit guide in the upper wellhead component and/or further comprise calculating a tension needed in the pipe string to keep the pipe string in tension based on a distance from the mandrel hanger to a surface.

These and other aspects, objects, features, and embodiments will be apparent from the following description and the appended claims. Those skilled in the art may apply the disclosed installation techniques for other applications.

BRIEF DESCRIPTION OF THE DRAWINGS

The drawings illustrate only example embodiments of adjustable mandrel hangers and are therefore not to be considered limiting in scope, as adjustable mandrel hangers may admit to other equally effective embodiments. The elements and features shown in the drawings are not necessarily to scale, emphasis instead being placed upon clearly illustrating the principles of the example embodiments. The methods described in connection with the drawings illustrate certain steps for carrying out the techniques of this disclosure. However, the methods may include more or less steps than explicitly described in the example embodiments. Two or more of the described steps may be combined into one step or performed in an alternate order. Moreover, one or more steps in the described method may be replaced by one or more equivalent steps known in the art to be interchangeable with the described step(s).

DETAILED DESCRIPTION OF EXAMPLE EMBODIMENTS

Figure 1:
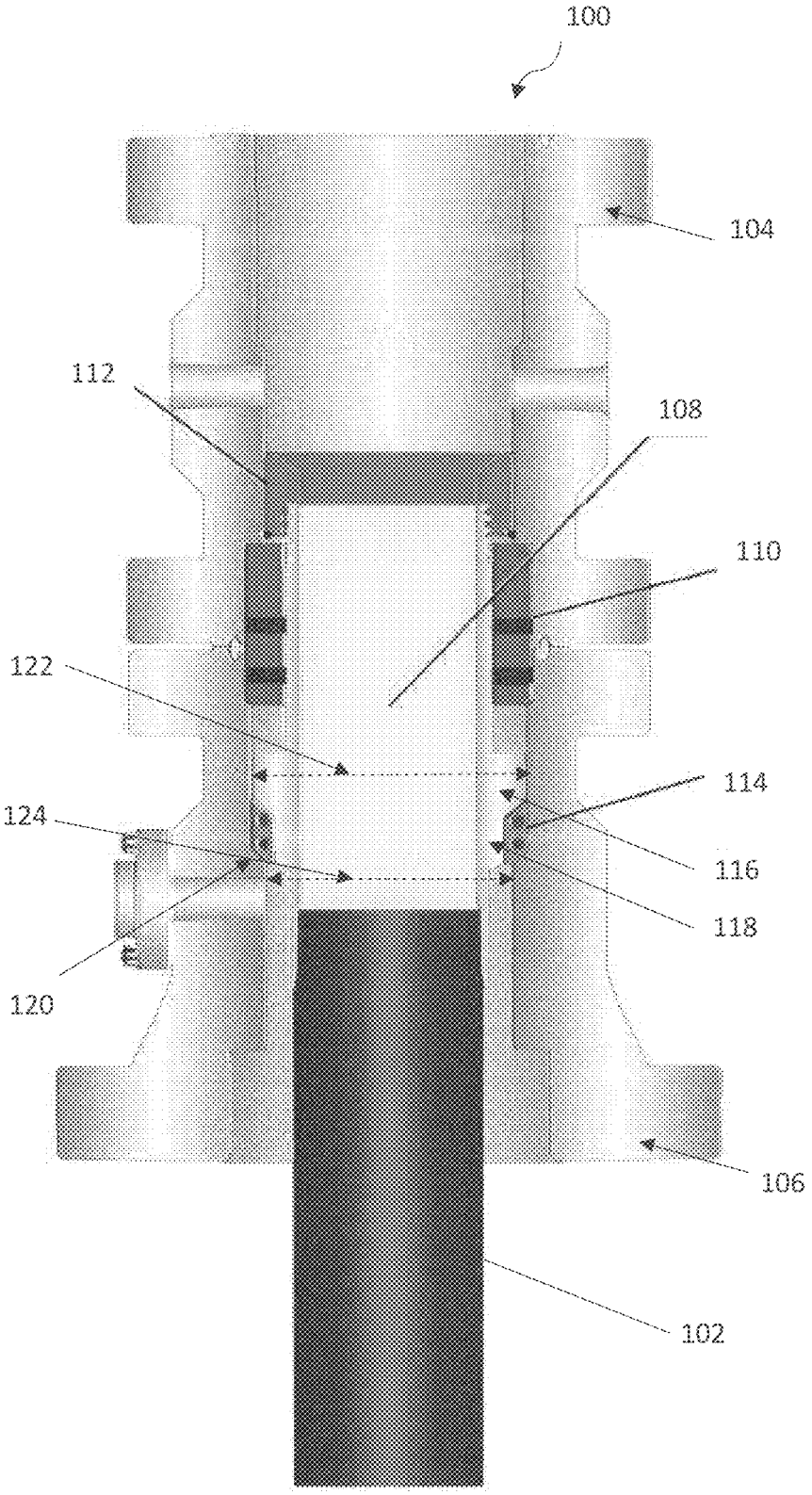
FIG. 1 is a cross-section of an example installed adjustable mandrel hanger assembly with a pipe string attached.

One general embodiment of the disclosure is a height adjustable mandrel hanger which comprises an upper wellhead component, a lower wellhead component comprising a load shoulder, a seal, a mandrel hanger, and an adjustment ring. The adjustment ring is chosen from a set of adjustment rings of different heights, such that the height of the ring positions the mandrel hanger at the correct height to create the needed tension throughout the pipe string.

Definitions

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements. Unless defined otherwise, all technical and scientific terms used herein have the same meanings as commonly understood by one of skill in the art to which the disclosed invention belongs.

The use of the term "about" generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%. The term "exactly," when used explicitly, refers to an exact number.

It is understood that when combinations, subsets, groups, etc. of elements are disclosed (e.g., combinations of components in a composition, or combinations of steps in a method), that while specific reference to each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

As used herein, a "wellhead component" is any individual outer component of the wellhead assembly, including part of the Christmas tree. For example, a wellhead component could be a spool, a wellhead, a tree body component, a casing header, casing spool, tubing head, tubing spool, or crossover spool, or multi-stage cross-over spool. When two wellhead assembly components are referred to as upper and lower, it is understood that the upper and lower components are directly connected.

As used herein, "protrusion" refers to an intrinsic component of a mandrel hanger which extends outwardly from the exterior of the mandrel hanger. The mandrel hanger can include one or more protrusions that extend outwardly concentrically from the exterior of the mandrel hanger around the circumference of the mandrel hanger. For example, the mandrel hanger can include four protrusions arranged around the circumference on the mandrel hanger. In some embodiments, the protrusion is a ridge that extends fully around the circumference of the mandrel hanger, thereby circumventing the mandrel hanger.

As used herein, "contact" refers to two components that touch. In some embodiments, the two components are placed side by side with their sides touching. In other embodiments, one component can fully surround the second component. In another embodiment, one component can partially surround the other component.

As used here, a "pipe string" is any string that is hanging from a mandrel hanger. For example, the pipe string could be a riser, such as an inner riser, a liner, a production string, a tieback string, or a casing.

Adjustable Mandrel Hanger Assembly

Example embodiments directed to the height adjustable mandrel hangers will now be described in detail with reference to the accompanying figures. Like, but not necessarily the same or identical, elements in the various figures are denoted by like reference numerals for consistency.

FIG. 1 illustrates an assembled adjustable mandrel hanger assembly 100 with a pipe string 102 attached. The adjustable mandrel hanger assembly 100 includes an upper wellhead component 104, a lower wellhead component 106, a mandrel hanger 108, a seal assembly 110, a bit guide 112, and an adjustment ring 114. The mandrel hanger 108 further comprises a first protrusion 116 which is a ridge which circumscribes the mandrel hanger 108, and a second protrusion 118 which is another ridge which circumscribes the mandrel hanger 108 and has a different exterior diameter than the first protrusion 116. In alternate embodiments, the first and second protrusion can be disposed on a portion of the exterior of the mandrel hanger 108, but not circumscribe the entire circumference of the mandrel hanger 108. The lower wellhead component 106 comprises a load shoulder 120. In this example embodiment, the mandrel hanger 108 is not a pass-through mandrel hanger, as the exterior diameter of the first protrusion 122 is larger than the interior diameter of the load shoulder 124. That is, when the mandrel hanger 108 is lowered into the lower wellhead component 106 (without an adjustment ring 114 present) the first protrusion will contact the load shoulder 120, thus resting the mandrel hanger 108 on the load shoulder 120 with the pipe string 102 hanging therefrom. As the adjustment ring 114 is able to increase the height of the mandrel hanger 108 to the desired height to create the desired tension in the pipe string 102, the mandrel hanger 108 does not need to be cut.

Figures 2A, 2B, 2C:
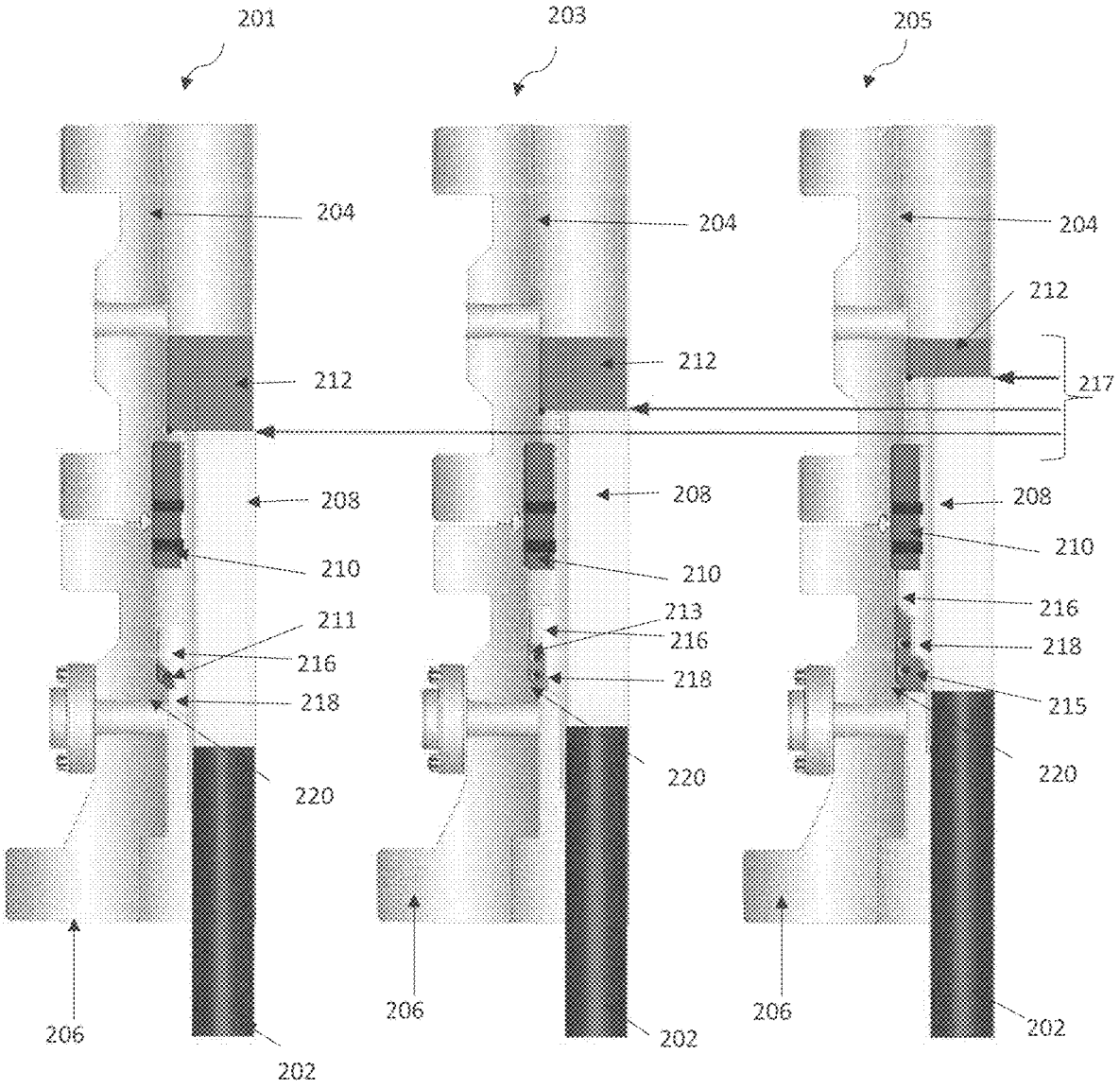
FIGS. 2*a*, 2*b*, and 2*c* illustrate examples of half a cross-section of three different installations of a mandrel hanger assembly, each installed with a different height adjustment ring to create the proper height depending on the distance to surface.

FIGS. 2*a*, 2*b*, and 2*c* illustrate examples of half of a cross-section of a series of adjustable mandrel hanger assemblies 201, 203, 205 with pipe string 202 attached. The adjustable mandrel hanger assemblies comprise an upper wellhead component 204, a lower wellhead component 206, a mandrel hanger 208, a seal assembly 210, a bit guide 212, and each comprises a different adjustment ring: a first adjustment ring 211, a second adjustment ring 213, and a third adjustment ring 215. The adjustment rings 211, 213, and 215 have the same interior diameter at least in a portion of the adjustment ring in order to fit around the mandrel hanger 208. However, each adjustment ring 211, 213 and 215 is a different height. The first adjustment ring 211 is the shortest, the second adjustment ring 213 is a middle length, and the third adjustment ring 215 is the tallest. In this way, a different height of adjustment ring can be used depending on the height needed to place the mandrel hanger 208 at the correct height to reach the correct tension within the pipe string 202. The height 217 of each mandrel hanger 208 is shown to the right of FIG. 2*c*, highlighting that the different height adjustment rings are able to change the height of the mandrel hanger 208, and thereby the tension within the pipe string 202. The mandrel hanger 208 further comprises a first protrusion 216 which is a ridge which circumscribes the mandrel hanger 208, and a second protrusion 218 which is another ridge which circumscribes the mandrel hanger 208 and has a different exterior diameter than the first protrusion 216. In alternate embodiments, the first and second protrusion can be disposed on a portion of the exterior of the mandrel hanger 208, but not circumscribe the entire circumference of the mandrel hanger 208. The lower wellhead component 206 comprises a load shoulder 220. In this embodiment, the mandrel hanger 208 is not a pass-through mandrel hanger, as the exterior dimeter of the first protrusion 216 is larger than the interior diameter of the load shoulder 220 Thus, when no adjustment rings 211, 213, and 215 are installed, when the mandrel hanger 208 is lowered into the lower wellhead component 206, the first protrusion 216 will end up resting on the load shoulder 220. When an adjustment ring 211, 213, or 215 is installed, the adjustment ring 211, 213 or 215 will rest on the load shoulder 220, hanging the pipe string 202 therefrom. As the adjustment rings are able to increase the height of the mandrel hanger 208 to the desired height to create the desired tension in the pipe string 202, the mandrel hanger 208 does not need to be cut.

Figure 3:
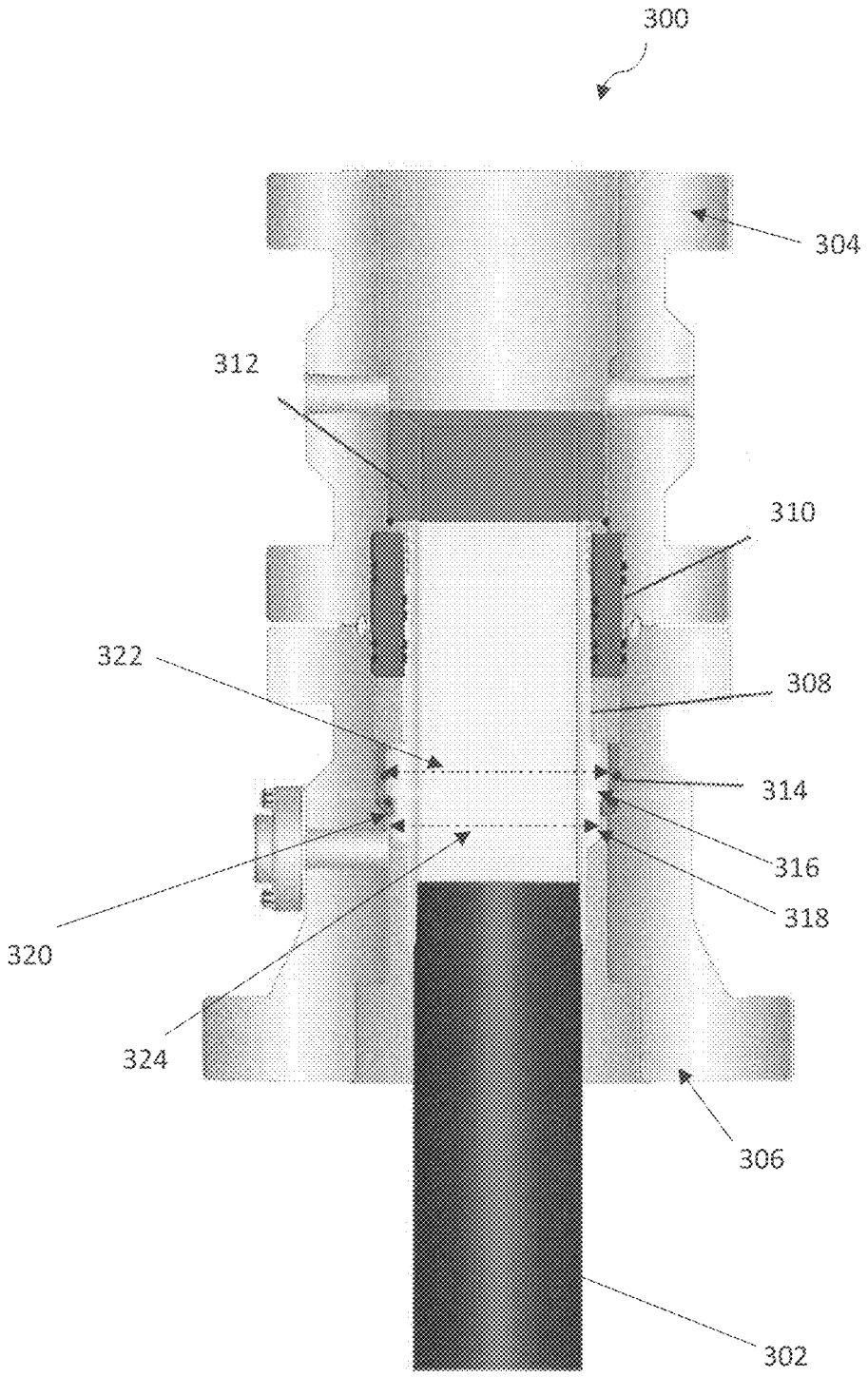
FIG. 3 is a cross-section of an example of a pass-through mandrel hanger assembly with a pipe string attached.

FIG. 3 illustrates another embodiment of an assembled adjustable mandrel hanger assembly 300 with a pipe string 302 attached. The adjustable mandrel hanger assembly 300 includes an upper wellhead component 304, a lower wellhead component 306, a pass-through mandrel hanger 308, a seal assembly 310, a bit guide 312, and an adjustment ring 314. The pass-through mandrel hanger 308 further comprises a first protrusion 316 which is a ridge which circumscribes the mandrel hanger 308, and a second protrusion 318 which is another ridge which circumscribes the mandrel hanger 308 and has a different exterior diameter than the first protrusion 316. In alternate embodiments, the first and second protrusion can be disposed on a portion of the exterior of the mandrel hanger 308, but not circumscribe the entire circumference of the mandrel hanger 308. The lower wellhead component 306 comprises a load shoulder 320. In this embodiment, if no adjustment ring 314 is installed, the pass-through mandrel hanger 308 is able to pass through the lower wellhead component 306, as the exterior diameter of the first protrusion 322 is smaller than the interior diameter of the load shoulder 324. When an adjustment ring 314 is installed, as shown, the adjustment ring 314 increases the largest diameter of the pass-through mandrel hanger 308 such that the diameter of the installed adjustment ring 314 is larger than the interior diameter of the load shoulder 324, and thus, the adjustment ring 314 will rest on the load shoulder 320, as shown. As the adjustment ring 314 contacts and partially covers the first protrusion 316, the adjustment ring 314 cannot slide along the pass-through mandrel hanger 308, even with the added weight of the pipe string 302. As the adjustment ring 314 is able to increase the height of the mandrel hanger 308 to the desired height to create the desired tension in the pipe string 302, the mandrel hanger 308 does not need to be cut.

Figures 4A, 4B, 4C:
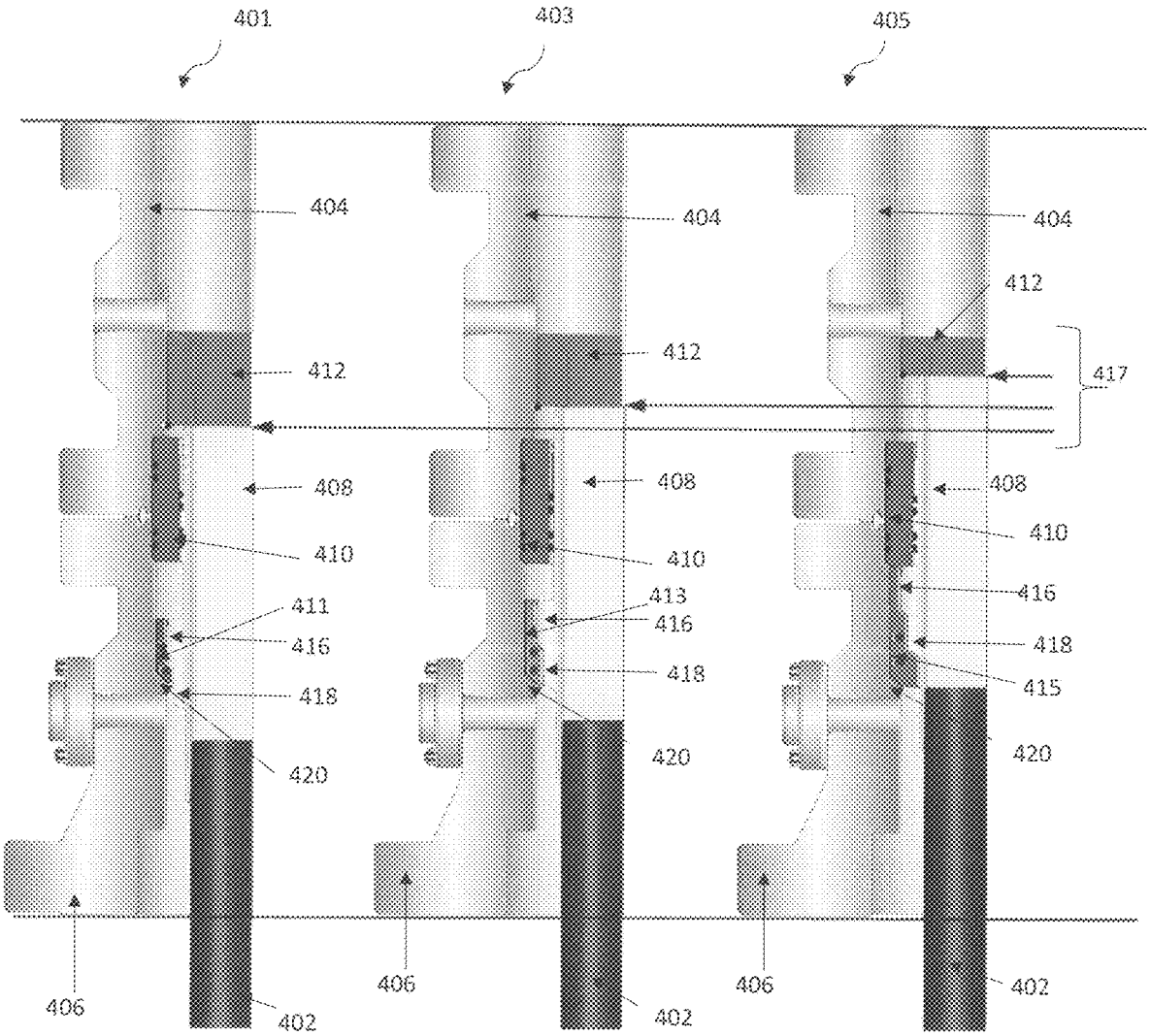
FIGS. 4*a*, 4*b*, and 4*c* illustrate examples of half a cross-section of three different installations of a pass-through mandrel hanger assembly, each installed with a different height adjustment ring to create the proper tension.

FIGS. 4*a*, 4*b*, and 4*c* illustrate examples of half of a cross-section of a series of adjustable mandrel hanger assemblies 401, 403, 405 with pipe string 402 attached. The adjustable mandrel hanger assemblies comprise an upper wellhead component 404, a lower wellhead component 406, a pass-through mandrel hanger 408, a seal assembly 410, a bit guide 412, and each comprises a different adjustment ring: a first adjustment ring 411, a second adjustment ring 413, and a third adjustment ring 415. The adjustment rings 411, 413, and 415 have at least a portion of the same interior diameter in order to fit around the pass-through mandrel hanger 408. However, each adjustment ring 411, 413, and 415 is a different height. The first adjustment ring 411 is the shortest, the second adjustment ring 413 is a middle length, and the third adjustment ring 415 is the tallest. In this way, a different height of adjustment ring can be used depending on the height needed to place the pass-through mandrel hanger 408 at the correct height to reach the correct tension within the pipe string 402. The height 417 of each mandrel hanger 408 is shown to the right of FIG. 4*c*, highlighting that the different height adjustment rings are able to change the height of the mandrel hanger 408, and thereby the tension within the pipe string 402. The pass-through mandrel hanger 408 further comprises a first protrusion 416 which is a ridge which circumscribes the pass-through mandrel hanger 408, and a second protrusion 418 which is another ridge which circumscribes the pass-through mandrel hanger 408 and has a different diameter than the first protrusion 416. In alternate embodiments, the first and second protrusion can be disposed on a portion of the exterior of the mandrel hanger 408, but not circumscribe the entire circumference of the mandrel hanger 408. The lower wellhead component 406 comprises a load shoulder 420. In this embodiment, the pass-through mandrel hanger 408 is able to pass-through the lower wellhead component 406 when lowered through it, as the exterior diameter of the first protrusion 416 is smaller than the interior diameter of the load shoulder 420. When an adjustment ring 411, 413, or 415 is installed, the diameter of the mandrel hanger is essentially expanded beyond the interior diameter of the load shoulder 420 and the adjustment ring 411, 413 or 415 will rest on the load shoulder 420, hanging the pipe string 402 therefrom. As the adjustment rings are able to increase the height of the mandrel hanger 408 to the desired height to create the desired tension in the pipe string 402, the mandrel hanger 408 does not need to be cut.

In example embodiments, the upper wellhead component is a spool, a wellhead, a tree body component, a casing header, casing spool, tubing head, tubing spool, or crossover spool, or multi-stage cross-over spool. In example embodiments, the lower wellhead component is a spool, a wellhead, a tree body component, a casing header, casing spool, tubing head, tubing spool, or crossover spool, or multi-stage cross-over spool. In example embodiments, the pipe string is a riser, an inner riser, a liner, a production string, a tieback string, or a casing. In some example embodiments, a bit guide is not included in the adjustable mandrel hanger assembly. In some example embodiments, a set of bit guides, each of a different height, is included in the adjustable mandrel hanger assembly. In some example embodiments, such as those illustrated in FIGS. 2*a*, 2*b*, and 2*c* and FIGS. 4*a*, 4*b*, and 4*c*, each bit guide from a set of bit guides matches with an adjustment ring of a set of adjustment rings, such that the height of adjustment ring plus the matching bit guide equals the height of all of the other matching bit guides and adjustment rings.

In example embodiments, the exterior of the mandrel hanger is threadless and grooveless. In embodiments, the load shoulder is a single load shoulder. In example embodiments, the load shoulder has a single load profile. In example embodiments, the interior of the load shoulder is threadless and grooveless.

As illustrated in the foregoing examples, instead of comprising threading or grooves, the mandrel hanger comprises protrusions that can rest against a load shoulder or an adjustment ring. The adjustment rings are installed below the protrusions contacting the protrusions, partially covering, or fully covering the protrusions, such that when the adjustment ring is installed and weight is hanging from the mandrel hanger, the ring is not able to slide up the mandrel hanger. In embodiments, there are a plurality of protrusions, for example 2, 3, 4, 5, 6, 7, 8, 9 or 10 protrusions located concentrically around the mandrel hanger. In some embodiments, the protrusion is a ridge that extends fully around the mandrel hangers' exterior circumference (concentrically), whereas in other embodiments the protrusion extends for only part of the exterior circumference of the mandrel hanger. In some embodiments, the mandrel hanger can comprise more than one ridge, such as 2, 3, 4 or 5 ridges. In embodiments with a plurality of ridges, each ridge abuts another ridge, but is of a different width and/or height.

In some embodiments, the adjustable mandrel hanger assembly is installed in an off-shore or an on-shore location. In some embodiments, the adjustable mandrel hanger assembly is installed on a platform, a drillship, or a floating production system vessel.

Figure 5:
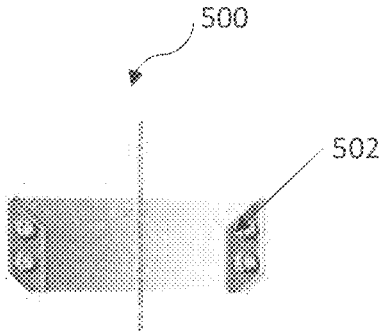
FIG. 5 is a vertical cross-section of an embodiment of an adjustment ring which comprises two sections.

FIG. 5 is a side view of a first half of an adjustment ring 500. The adjustment ring comprises screw holes 502. The second half the adjustment ring 500 will also comprise screw holes, such that when a screw is inserted into the screw holes of the second half of the adjustment ring, and screwed into the screw holes 502 of the first half of the adjustment ring, the first and second halves of the adjustment ring form a whole ring. When placed around a mandrel hanger, the screws can be tightened such that the adjustment ring is attached to the mandrel hanger in such a way that it cannot slide up or down around the mandrel hanger.

Figure 6:
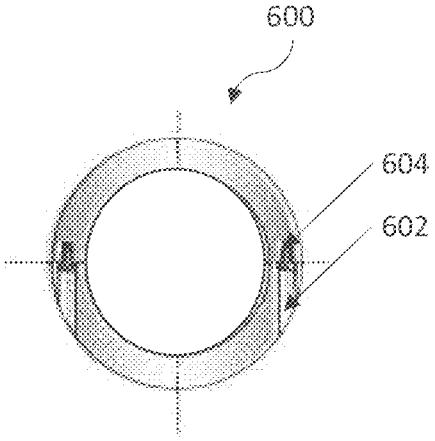
FIG. 6 is a horizontal cross-section of the adjustment ring of FIG. 5 showing two half sections attached.

FIG. 6 is a cross-section from the top view of an embodiment of an adjustment ring 500 which comprises screw holes 602 and screws 604. The screw 604 fits through the screw hole 602 on one side of the adjustment ring 600 and screws into screw holes with threading in the second half of the adjustment ring.

In other embodiments, the adjustment ring can comprise a hinge on one side and an adjustable latch on the other, such that the ring can be opened at the hinges and then attached around a mandrel hanger using the adjustable latch. In some embodiments, the adjustment ring can comprise a hinge on one side and screw holes on the other side, such that the adjustment ring can fit securely around the mandrel hanger. Any combination of components that allow the adjustment ring to fit around the mandrel hanger can be applied to the example embodiments of the disclosure. For example, the adjustment ring could also be made of three or more ring segments that can then be attached together, for example through screws or latches.

Figure 7:
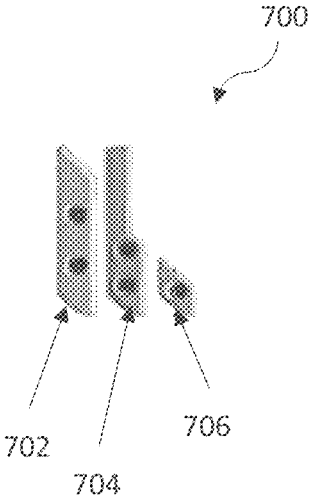
FIG. 7 is an example of a set of adjustment rings.

FIG. 7 is half a cross section of a set of adjustment rings 700. The adjustment ring set 700 comprises a first adjustment ring 702, a second adjustment ring 704, and a third adjustment ring 706. Each adjustment ring is of a different height. The second adjustment ring 704 is contoured to secure around a protrusion on a mandrel hanger. That is, the second adjustment ring has a smaller internal dimeter at the bottom of the adjustment ring that will fit around the exterior diameter of the mandrel hanger, but also includes a larger interior diameter that is configured to fit around a protrusion of the mandrel hanger.

Figure 8:
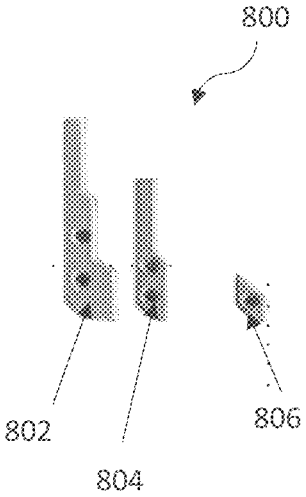
FIG. 8 is a second example of a set of adjustment rings.

FIG. 8 is half a cross section of a set of adjustment rings 800. The adjustment ring set 800 comprises a first adjustment ring 802, a second adjustment ring 804, and a third adjustment ring 806. Each adjustment ring is of a different height. The second adjustment ring 804 is contoured on the interior to fit around the circumference of a mandrel hanger and the circumference of a protrusion on the mandrel hanger. The first adjustment ring 802 is contoured on the interior of the adjustment ring to fit around the circumference of a mandrel hanger, the circumference of a protrusion on the mandrel hanger, and the circumference of a second protrusion on the mandrel hanger.

Figure 9:
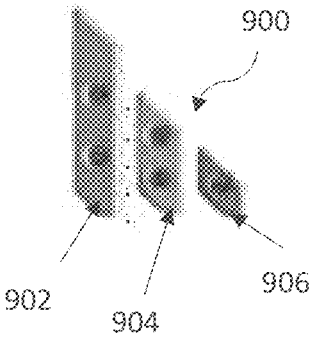
FIG. 9 is a third example of a set of adjustment rings.

FIG. 9 is half a cross section of a set of adjustment rings 900. The adjustment ring set 900 comprises a first adjustment ring 902, a second adjustment ring 904, and a third adjustment ring 906. Each adjustment ring is of a different height. The top of each adjustment ring is contoured (beveled) to match the bottom of a protrusion on a mandrel hanger. This adjustment ring set 900 will not fit over the protrusion on a mandrel hanger but will instead abut the protrusions on the lower side of the mandrel hanger.

In specific embodiments, a plurality of adjustment rings are packaged as an adjustment ring set with a corresponding mandrel hanger. In specific embodiments, 2, 3, 4, 5, 6, 7, 8, 9, 10, 11, 12, 13, 14, 15 or more adjustment rings are packaged with a corresponding mandrel hanger. In some embodiments, the adjustment rings can be stacked to create the height needed for the correct tension. In some embodiments, the adjustment rings in an adjustment ring set are all the same height. In other embodiments, one or more adjustment rings in an adjustment ring set is a different height from one or more of the other adjustment rings in the set. In some embodiments, the two adjustment rings, three adjustment rings, four adjustment rings, five adjustment rings, or more are stacked together to create the additional height needed to properly tension a pipe string.

In an embodiment using stacked rings, only one ring needs to contact protrusions from the mandrel hanger. However, more than one ring can contact, partially cover, or fully cover one or more protrusions on the mandrel hanger. In some embodiments, one or more adjustment rings can contact, partially cover, or fully cover the protrusions on the mandrel hanger. In some embodiments, one or more adjustment rings can have different internal diameters than one or more other adjustment rings in a set of adjustment rings. In other embodiments, one or more adjustment rings can have the same internal diameters than one or more other adjustment rings in a set of adjustment rings. In some embodiments, each adjustment ring in a set of adjustment rings can have bevels of the same angles and have the same internal diameter. In some embodiments, one or more adjustment rings can have the same or different heights than one or more other adjustment rings in a set of adjustment rings. In embodiments including stacked adjustment rings, the stacked adjustment rings can comprise bolt holes such that the stacked rings can be secured together. In some embodiments, an adjustment ring can be additionally secured to a protrusion on a mandrel hanger, such as through the use of an additional bolt.

In some embodiments, an adjustment ring can have one internal diameter. In other embodiments, an adjustment ring can have different internal diameters, such that the inside of the ring is contoured to partially or fully cover one or more protrusions on a corresponding mandrel hanger. In some embodiments, the upper end of an adjustment ring is beveled such that the angle of the bevel matches the angle of a protrusion on a corresponding mandrel hanger.

In some embodiments, an adjustment ring may have a height of between 1 inch and 6 feet. For example, an adjustment ring can be between 1 inch to 1 ft., 1 ft. to 2 ft., or 2 ft. to 3 ft. In some embodiments, the thickness of a side of an adjustment ring can be between 0.5-3 inches. In embodiments, the outside of the ring is smooth; that is, the outside of the ring does not need to include threading, grooves, or any other machining.

Method of Use

Example embodiments directed to the method of using height adjustable mandrel hangers will now be described in detail with reference to the accompanying figures. Like, but not necessarily the same or identical, elements in the various figures are denoted by like reference numerals for consistency.

The method comprises using an adjustable mandrel hanger assembly to correctly tension a pipe string using adjustable rings which adjust the height of the mandrel hanger relative to the bottom surface of the well. The adjustable mandrel hanger assembly comprises an upper wellhead component, a lower wellhead component comprising a load shoulder, a mandrel hanger sized such that it can slide into the upper and lower wellhead components, wherein the mandrel hanger comprises a protrusion disposed on an exterior of the mandrel hanger, a seal assembly sized such that it can seal the annulus between the mandrel hanger and the lower wellhead component, and a height adjustment ring, wherein the height adjustment ring fits securely around the mandrel hanger contacting at least a portion of the protrusion and wherein a largest exterior diameter of the height adjustment ring is greater than an interior diameter of the load shoulder. The upper wellhead component, lower wellhead component, mandrel hanger, seal assembly, and a set of adjustable rings of different heights can be packaged together as a set.

Figure 13:
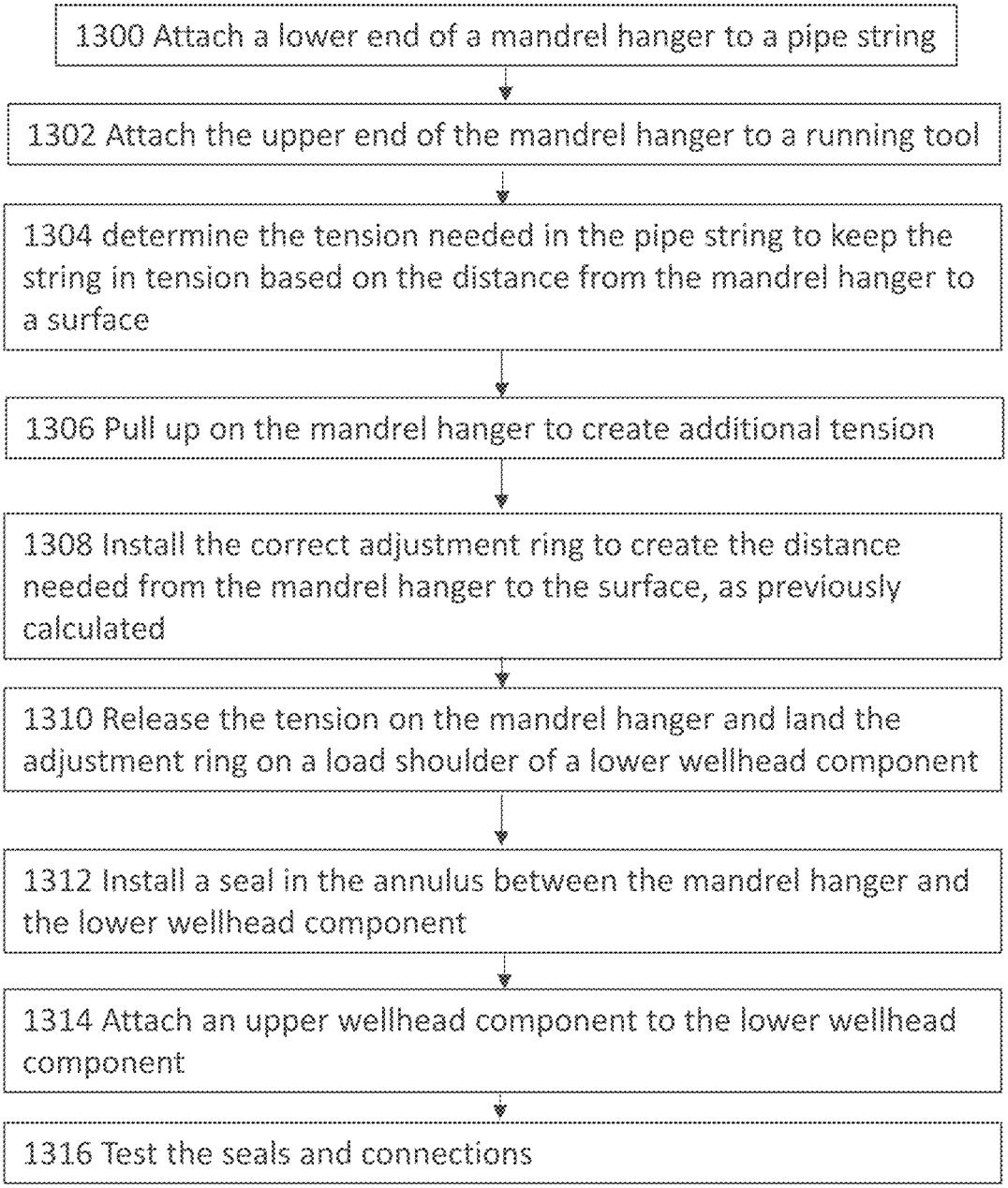
FIG. 13 is a flow chart of the example steps used to install a mandrel hanger assembly of the disclosure.

FIG. 13 illustrates an example embodiment of a method of installing the adjustable mandrel hanger assembly. A length of pipe string with a bottom end attached at a subsea wellhead, for example, is attached at the upper end to a mandrel hanger (step 1300), usually at a platform. The upper end of the mandrel hanger assembly is attached to a running tool, for example (step 1302) The length of pipe string can be between 1500-30000 feet long. The amount of tension needed to keep the pipe string in tension based on the distance from the subsea wellhead to the platform is determined (step 1304). In step 1306 the mandrel hanger is raised. In step 1308 an adjustment ring is installed around the mandrel hanger, at the correct position to create the needed tension determined in step 1304. The additional tension on the mandrel hanger is released. The adjustment ring, and thereby the mandrel hanger, is landed on a load shoulder of a lower wellhead component (step 1310). In step 1312 a seal assembly is installed in the annulus between the mandrel hanger and the lower wellhead component. An upper wellhead component is then attached to the lower wellhead component (step 1314), after which the seals and connections of the adjustable mandrel hanger assembly are tested (1316).

Figure 10:
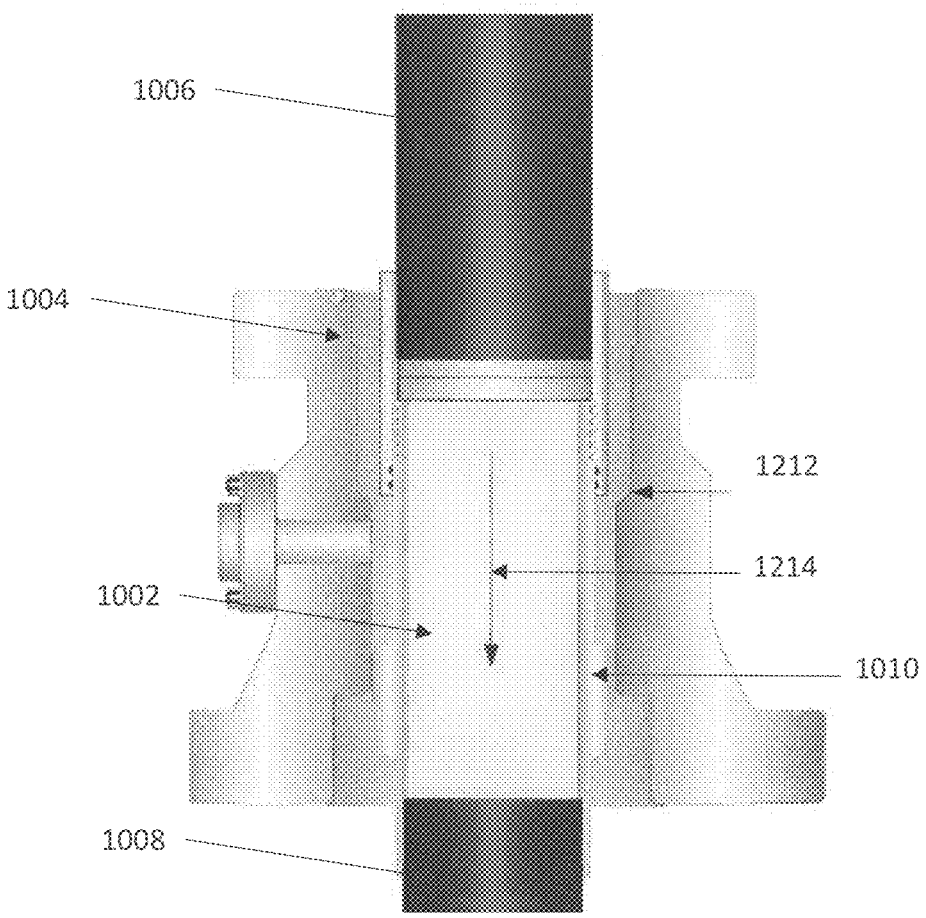
FIG. 10 shows a cross-section of a pass-through mandrel hanger that has passed the load shoulder.

FIG. 10 illustrates a pass-through mandrel hanger 1002 being lowered through a lower wellhead component 1004. The pass-through mandrel hanger 1002 is attached to a running string 1006 on the upper end of the pass-through mandrel hanger 1002 and is attached to a pipe string 1008 on the lower end of the pass-through mandrel hanger 1002. As the widest mandrel hanger protrusion 1010 is less than the internal diameter of the load shoulder 1212, the pass-through mandrel hanger 1002 is able to passthrough the lower wellhead component 1004. The force 1214 on the mandrel hanger due to weight of the pipe string 1008 is shown.

Figure 11:
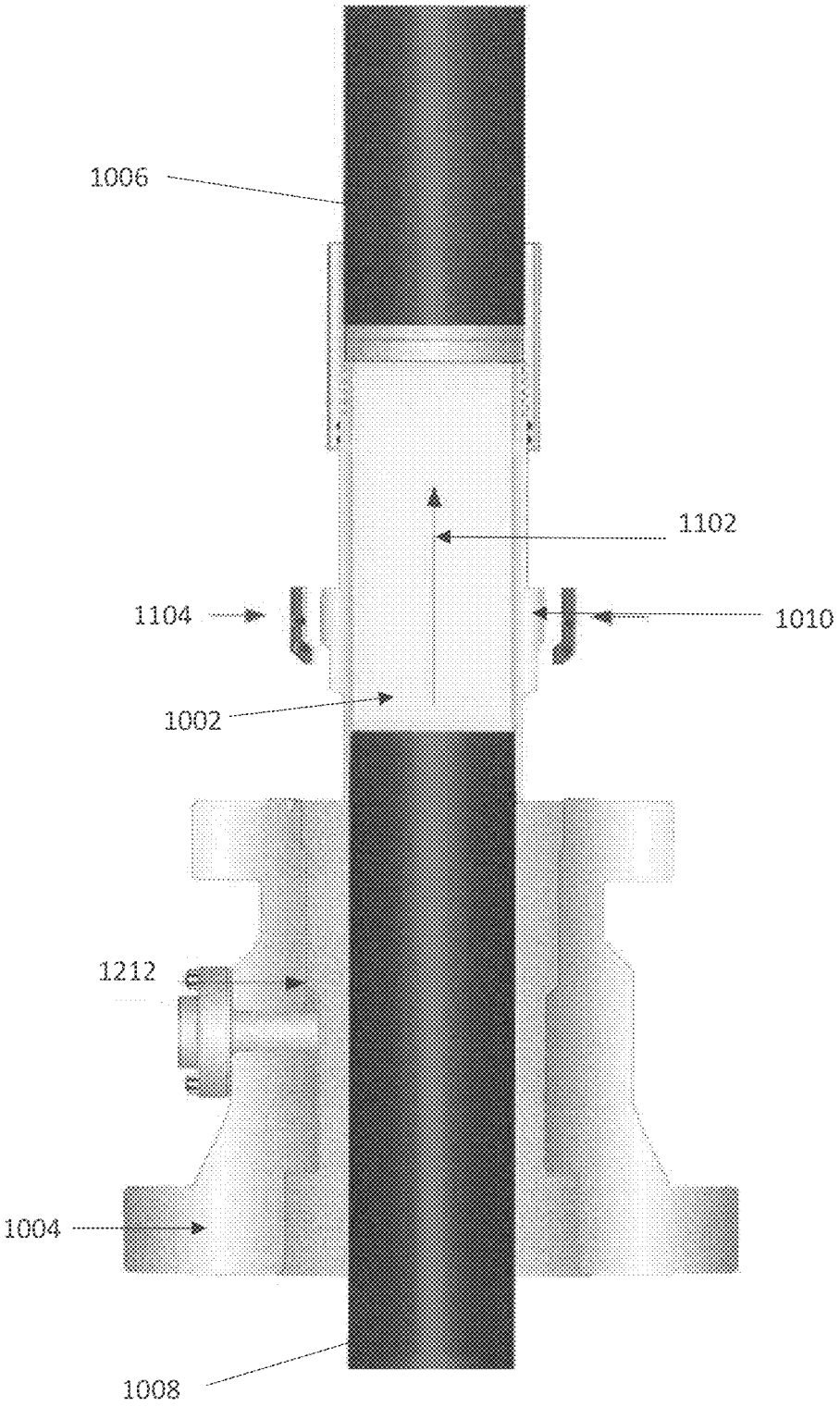
FIG. 11 shows a cross-section of a pass-through mandrel hanger that has upward tension applied with the height adjustment rings about to be installed.

FIG. 11 illustrates the set-up of the adjustable mandrel hanger assembly as would be seen after FIG. 10. Upward tension 1102 is applied to the pass-through mandrel hanger 1002 by pulling up on the running string 1006, allowing access to the pass-through mandrel hanger 1002. An adjustment ring 1104 is secured around the pass-through mandrel hanger 1002 on the lower end of the mandrel hanger ridge 1010 contacting and partially surrounding the mandrel hanger ridge 1010.

Figure 12:
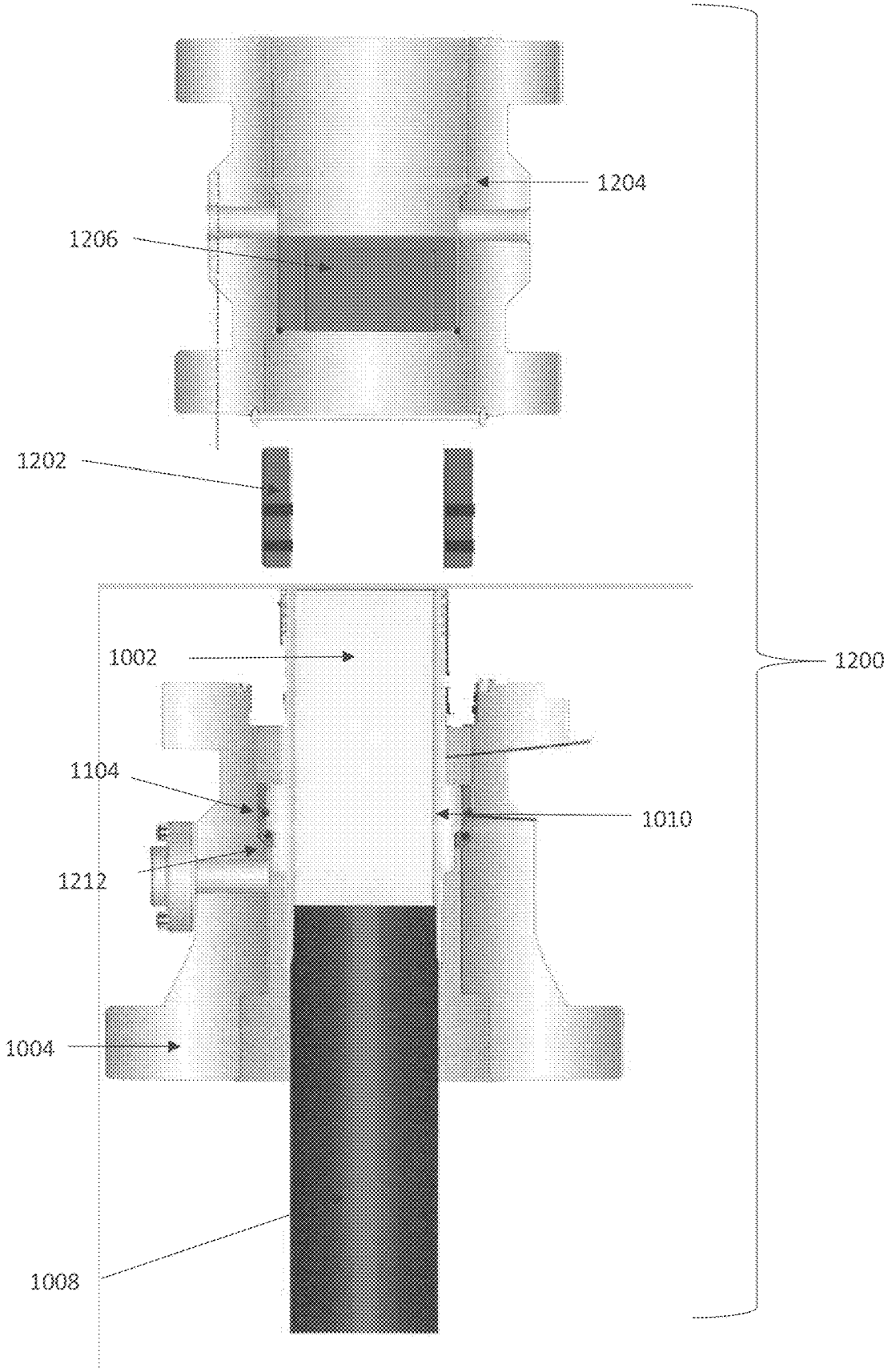
FIG. 12 shows a cross-section of a pass-through mandrel hanger with installed height adjustment rings that has been landed on a load shoulder. A seal assembly and an upper wellhead component are about to be installed.

FIG. 12 illustrates the set-up of the adjustable mandrel hanger assembly 1200 as would be seen after FIG. 11. The adjustment ring 1104 has been landed on the load shoulder 1212 with the pipe string 1008 hanging therefrom and with the running tool 1006 detached and removed. The seals 1202 and upper wellhead component 1204 including bit guide 1206 are in position to install.

A specific embodiment of using the adjustable mandrel hanger is using the adjustable mandrel hanger to properly tension an inner riser. In this case, the mandrel hanger is a riser hanger mandrel. The riser hanger mandrel is run as the last joint of an inner riser string and is attached to a running tool. After internal tieback is set and lockdown is verified, an overpull is performed on the riser to the project's specified requirements and the inner riser is tested. The amount of tension, and thereby the correct height for positioning the mandrel hanger is calculated. After testing, the running tool is pulled up to the desired tension. Once this tension is reached, a first mark is placed on the hanger mandrel even with the top of the casing head. The tension is increased, pulling the mandrel hanger higher to the correct measurement (load shoulder depth in wellhead) to be marked on the hanger mandrel below the first marked measurement. The tension is again increased, allowing access to the mandrel hanger protrusions. An adjustment ring of the correct height to position the mandrel hanger at a height for the correct inner riser tension is installed below and contacting a mandrel hanger protrusion. The mandrel hanger is lowered into the lower wellhead component and landed on the load shoulder of the lower wellhead component. The seal assembly is then installed in the anulus between the mandrel hanger and the lower wellhead component. The upper wellhead component is then installed on top of the lower wellhead component. No parts of the pipe string or mandrel hanger are removed by cutting and no adjustments to the height of the string are made through cutting. Additionally, no machining is needed on the outside of the mandrel hanger, the outside of the adjustment ring, or the inside of the load shoulder or lower wellhead component. Six to eight hours are saved as no cutting or additional matching are necessary. This process also reduces the possibility of injuries in handling the cutter and cutting chips. Additionally, it reduces opportunity for debris from the cutting operation to fall downhole or mis-matching resulting in replacing a riser joint.

In embodiments, the correct tension and/or height of the mandrel hanger is calculated. One example of such a calculation is Tension/Height=wet weight (length dependent) of pipe string+pipe stretch+/−offset of facility location factor+prescribed tension factor/effective tension per API Specification 2RD at various load cases all to accommodate the movement of the riser relative to the vessel. Additional examples can be found in API Specification 2RD Annex A or ABS Guidance Notes publication, incorporated herein in full.

The description and illustration of one or more embodiments provided in this application are not intended to limit or restrict the scope of the invention as claimed in any way. The embodiments, examples, and details provided in this disclosure are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope. For instance, such other examples are intended to be within the scope of the claims if they have structural or methodological elements that do not differ from the literal language of the claims, or if they include equivalent structural or methodological elements with insubstantial differences from the literal language of the claims, etc. All citations referred to herein are expressly incorporated by reference.

What is claimed is:

1. An adjustable mandrel hanger assembly comprising:

an upper surface wellhead component;

a lower surface wellhead component comprising a load shoulder;

a surface mandrel hanger sized such that it can slide into the upper and lower surface wellhead components, wherein the surface mandrel hanger comprises a protrusion disposed on an exterior of the surface mandrel hanger and wherein the exterior of the surface mandrel hanger is threadless and grooveless;

a seal assembly sized such that it can seal the annulus between the surface mandrel hanger and the lower surface wellhead component; and a height adjustment ring, wherein the height adjustment ring fits around the surface mandrel hanger contacting at least a portion of the protrusion and wherein a largest exterior diameter of the height adjustment ring is greater than an interior diameter of the load shoulder.

2. The adjustable mandrel hanger assembly of claim 1, further comprising a plurality of bit guides, wherein each bit guide of the plurality of bit guides is a different height.

3. The adjustable mandrel hanger assembly of claim 1, wherein a largest exterior diameter of the protrusion is less than the interior diameter of the load shoulder.

4. The adjustable mandrel hanger assembly of claim 1, wherein a largest exterior diameter of the protrusion is greater than the interior diameter of the load shoulder.

5. The adjustable mandrel hanger assembly of claim 1, wherein an interior of the height adjustment ring is contoured to fit around at least the portion of the protrusion.

6. The adjustable mandrel hanger assembly of claim 5, wherein an exterior of the height adjustment ring, and an interior of the load shoulder are threadless and grooveless.

7. The adjustable mandrel hanger assembly of claim 1, further comprising a second height adjustment ring having a second height that is different from a height of the height adjustment ring.

8. The adjustable mandrel hanger assembly of claim 7, wherein the height adjustment ring and the second height adjustment ring are configured to stack against each other.

9. The adjustable mandrel hanger assembly of claim 1, wherein the height adjustment ring comprises two half circular sections that can be secured to each other to form the height adjustment ring.

10. The adjustable mandrel hanger assembly of claim 1, wherein the upper surface wellhead component is a spool, a wellhead, a tree body component, a casing header, or a casing spool, tubing head, tubing spool, crossover spool, or multi-stage cross-over spool.

11. The adjustable mandrel hanger assembly of claim 1, wherein the lower surface wellhead component is a spool, a wellhead, a tree body component, a casing header, or a casing spool, tubing head, tubing spool, crossover spool, or multi-stage cross-over spool.

12. A method of adjusting the tension in a mandrel hanger assembly comprising:

attaching one end of a surface mandrel hanger to a pipe string, the surface mandrel hanger comprising a protrusion disposed on an exterior of the surface mandrel hanger wherein the exterior of the surface mandrel hanger is threadless and grooveless;

attaching an opposite end of the surface mandrel hanger to a running tool;

raising the surface mandrel hanger to create tension in the pipe string;

installing an adjustment ring on the surface mandrel hanger, wherein the adjustment ring contacts at least a portion of the protrusion;

lowering the surface mandrel hanger and landing the surface mandrel hanger on a load shoulder of a lower wellhead component;

detaching the surface mandrel hanger from the running tool;

installing a seal in an annulus between the surface mandrel hanger and the lower wellhead component; and attaching an upper wellhead component to the lower wellhead component.

13. The method of claim 12, wherein a second adjustment ring is stacked on the adjustment ring.

14. The method of claim 13, wherein the adjustment ring and the second adjustment ring comprise different interior contours.

15. The method of claim 12, wherein a largest exterior diameter of the protrusion is less than an interior diameter of the load shoulder.

16. The method of claim 15, wherein a largest exterior diameter of the adjustment ring is greater than the interior diameter of the load shoulder.

17. The method of claim 12, wherein an interior of the adjustment ring is contoured to fit around at least a portion of the protrusion.

18. The method of claim 12, additionally comprising installing a bit guide in the upper wellhead component.

19. The method of claim 12, further comprising calculating a tension needed in the pipe string to keep the pipe string in tension based on a distance from the surface mandrel hanger to a subsea wellhead assembly.

20. The method of claim 12, wherein the surface mandrel hanger is not cut.

* * * * *